US008876240B2

(12) United States Patent
Imamura

(10) Patent No.: US 8,876,240 B2
(45) Date of Patent: Nov. 4, 2014

(54) IMAGE RECORDING APPARATUS AND RECORDING MEDIUM TRANSPORTATION CONTROL METHOD

(71) Applicant: Seiko Epson Corporation, Tokyo (JP)

(72) Inventor: Atsushi Imamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/863,626

(22) Filed: Apr. 16, 2013

(65) Prior Publication Data

US 2013/0278665 A1 Oct. 24, 2013

(30) Foreign Application Priority Data

Apr. 19, 2012 (JP) ..... 2012-095456

(51) Int. Cl.

| | |
|---|---|
| ***B41J 29/38*** | (2006.01) |
| ***B41J 29/393*** | (2006.01) |
| ***B41J 13/00*** | (2006.01) |
| ***B41J 11/04*** | (2006.01) |
| ***B41J 11/42*** | (2006.01) |
| *B41J 15/16* | (2006.01) |

(52) U.S. Cl.

CPC ..... *B41J 13/0009* (2013.01); *B41J 11/04* (2013.01); *B41J 15/165* (2013.01); *B41J 11/42* (2013.01)

USPC ..... 347/16; 347/19

(58) Field of Classification Search

CPC ..... B41J 29/36

USPC ..... 347/16, 19

See application file for complete search history.

(56) References Cited

U.S. PATENT DOCUMENTS

| | | | | |
|---|---|---|---|---|
| 6,460,982 | B1 * | 10/2002 | Ito et al. | 347/85 |
| 2008/0238998 | A1 * | 10/2008 | Nakazawa et al. | 347/42 |
| 2009/0244164 | A1 * | 10/2009 | Nakamaki et al. | 347/19 |
| 2010/0194812 | A1 * | 8/2010 | Castells et al. | 347/16 |
| 2012/0139982 | A1 * | 6/2012 | Abe | 347/14 |

FOREIGN PATENT DOCUMENTS

| | | | |
|---|---|---|---|
| JP | 10-086472 | A | 4/1998 |
| JP | 2001-054957 | A | 2/2001 |
| JP | 2011-201158 | A | 10/2011 |

* cited by examiner

*Primary Examiner* — Jason Uhlenhake

(74) *Attorney, Agent, or Firm* — Global IP Counselors, LLP

(57) ABSTRACT

There is provided an image recording apparatus including a transportation unit that transports a recording medium, a driven rotation member that rotates as a result of being driven depending on the recording medium which is transported by the transportation unit while in contact with the recording medium, a rotational position detection unit that detects a rotational position of the driven rotation member, and a control unit that controls an amount of transportation of the recording medium based on a result of the detection by the rotational position detection unit.

13 Claims, 6 Drawing Sheets

IMAGE RECORDING APPARATUS AND RECORDING MEDIUM TRANSPORTATION CONTROL METHOD

CROSS-REFERENCE TO RELATED APPLICATIONS

The entire disclosure of Japanese Patent Application No. 2012-095456, filed Apr. 19, 2012 is expressly incorporated by reference herein.

BACKGROUND

1. Technical Field

The present invention relates to a technology that controls an amount of transportation of a recording medium in transporting the recording medium.

2. Related Art

In JP-A-2001-054957, a configuration is disclosed in which the recording medium is transported using two transportation rollers. Specifically, a nip roller is provided with respect to each of the two transportation rollers that are in parallel with each other along a transportation path for the recording medium. Then, rotation of each transportation roller makes the recording medium be transported while the recording medium is interposed between each transportation roller and the nip roller. At this time, control of the amount of transportation of the recording medium is executed by counting drive pulses of a motor that drives the transportation roller.

In other words, in JP-A-2001-054957, it is disclosed that the amount of rotation of the transportation roller is set to reflect an amount of transportation of the recording medium, and the amount of transportation of the recording medium is controlled based on a counter value of the drive pulse that correlates with an amount of rotation of the transportation roller. However, because slipping easily occurs between the transportation roller and the recording medium, which are described above, it is practically difficult to precisely control the amount of transportation of the recording medium based on the counter value of the drive pulse. This respect is described in detail as follows.

The recording medium receives a force from the transportation roller and thus is transported. Therefore, it is necessary to rotate the transportation roller in a state where the force appropriately is transferred from the transportation roller to the recording medium, in order to transport the recording medium with the amount of transportation according to the amount of rotation of the transportation roller. However, the great drive force given by the motor is not always appropriately transferred from the transportation roller to the recording medium, and there are cases where the slipping occurs between the transportation roller and the recording medium. For this reason, it is difficult to control precise control of the amount of transportation of the recording medium based on the counter value of the drive pulse.

SUMMARY

An advantage of some aspects of the invention is to provide a technology that makes possible precise control of an amount of transportation of the recording medium.

According to an aspect of the invention, there is provided an image recording apparatus including a transportation unit that transports a recording medium, a driven rotation member that rotates as a result of being driven depending on the recording medium which is transported by the transportation unit while in contact with the recording medium, a rotational position detection unit that detects a rotational position of the driven rotation member, and a control unit that controls an amount of transportation of the recording medium based on a result of the detection by the rotational position detection unit.

According to another aspect of the invention, there is provided a recording medium control method that controls an amount of transportation of a recording medium being transported by a transportation unit, the method including detecting a rotational position of a driven rotation member that rotates as a result of being driven depending on the recording medium which is transported by the transportation unit while in contact with the recording medium, and controlling the amount of transportation of the recording medium based on a result of the detection in the detecting of the rotational position.

In the aspect of the invention with this configuration (the image recording apparatus and the recording medium transportation control method), a driven rotation member is provided that rotates as a result of being driven depending on the recording medium. The driven rotation member can rotate, almost without slipping with respect to the recording medium, because the driven rotation member is driven by being left subject to the transportation of the recording medium while in contact with the recording medium, without giving a great drive force to the recording medium as in the transportation roller described above. Therefore, the rotational position of the driven rotation member appropriately reflects the amount of transportation of the recording medium. Therefore, the aspect of the invention controls the amount of transportation of the recording medium, based on a result of detecting the rotational position of the driven rotation member. When this is done, the precise control of the amount of transportation of the recording medium becomes possible.

At this time, the driven rotation member may make up the image recording apparatus in such a manner that the driven rotation member is a driven drum onto the peripheral surface of which the recording medium is wound. By winding the recording medium onto the driven drum, which is the driven rotation member, in this manner, a frictional force is ensured between the driven drum and the recording medium. As a result, an occurrence of the slipping can certainly be suppressed between the driven drum and the recording medium, and this is advantageous in the precise control of the amount of transportation of the recording medium.

Furthermore, the image recording apparatus may further include a discharge head that discharges a liquid onto one surface of the recording medium to record an image. In the image recording, the recording medium may be supported by winding the recording medium onto the driven drum beginning with the other surface that is a reverse side of the one surface. The discharge head may make up the image recording apparatus in such a manner that the liquid is discharged onto a part of the recording medium that is wound onto the driven drum. Since the amount of transportation of the recording medium is detected with this configuration, the driven drum performs not only the function of being driven depending on the recording medium, but also the function of supporting the recording medium onto which the discharge head discharges the liquid. For this reason, because it is not necessary to provide a member for every function, this is advantageous in suppressing the number of the members and thereby accomplishing the minimization of the size of the image recording apparatus.

Furthermore, in the image recording apparatus the control unit may recording selectively execute an image recording mode in which the discharge head discharges the liquid to record the image on the recording medium while the transportation unit transports the recording medium along a first direction and a reverse transportation mode in which the transportation unit transports the recordable media along a second direction, which is the reverse of the first direction, and may control the amount of transportation of the recording medium in the reverse transportation mode based on a result of the detection by the rotational position detection unit.

In such an image recording apparatus, in addition to the image recording mode, the reverse transportation mode can be executed. Therefore, by appropriately executing the reverse transportation mode, the recording medium can be transported to position according to an operation that is performed in succession. Besides, since the amount of transportation of the recording medium in the reverse transportation mode may be precisely controlled based on the result of the detection by the rotational position detection unit, the recording medium can be precisely transported to the appropriate position for the operation that is performed in succession to the reverse transportation mode.

Moreover, various operations can be performed as the operation that is performed in succession to the reverse transportation mode. Therefore, the image recording apparatus may further include an aberration detection unit that detects an aberration which occurs in the image recording mode that is being executed. In the image recording apparatus, the control unit may interrupt, the image recording mode in order for the transportation unit to stop transporting the recording medium, when the aberration detection unit detects an aberration, and may perform a positional alignment between a position of the recording medium at which recording of the image starts in the resumed image recording mode and the discharge head, using the reverse transportation mode.

With this configuration, in a case where the aberration occurs in the image recording mode that is being executed, the image recording mode is interrupted. Therefore, while the image recording mode is interrupted, for example, maintenance necessary for solving the aberration may be appropriately performed. Moreover, in a case where the image recording mode is interrupted in this manner, there are times when the positional alignment between the position of the recording medium at which the image recording starts and the discharge head is necessary in the resumed image recording mode. In contrast, with this configuration, the positional alignment may be performed by executing the reverse transportation mode. Besides, since the amount of transportation of the recording medium in the reverse transportation mode is precisely controlled based on the result of the detection by the rotational position detection unit, the recording medium can be precisely transported to the appropriate position for the resumed image recording mode.

At this time, in the image recording apparatus, the aberration detecting unit may make detect the aberration that occurs in the image formed by the discharge head. With this configuration, the image recording mode is interrupted in a case where the aberration in the image is detected. As a result, the further recording of the image with the aberration on the recording medium can be suppressed and thus a waste of the recording medium can be suppressed.

Moreover, various aberrations are supposed to be the aberrations that occur in the image, and for example, a defect in dot formation, which is referred to as a dot omission, is considered. Therefore, in the image recording apparatus, the discharge head may discharge the liquid through a nozzle onto the recording medium to form a dot on the recording medium, and the aberration detection unit may detect a defect in dot formation that occurs due to the defect in discharge of the liquid through the nozzle. With this configuration, further recording of the image with the defect in dot formation on the recording medium can be suppressed, and thus the waste of the recording medium can be suppressed.

Furthermore, the image recording apparatus may further include a maintenance unit that performs maintenance on the nozzle of the discharge head. The control unit may make up the image recording apparatus in such a manner as to cause the maintenance unit to perform the maintenance with respect to the nozzle of the discharge head during an interval from stopping the image recording mode to resuming the image recording mode. With this configuration, in the resumed image recording mode, the appropriate image without the defect in dot formation can be recorded on the recording medium.

Furthermore, the image recording apparatus is configured in such a manner as to perform the following operation as an operation that is performed in succession to the reverse transportation mode. That is, in the image recording apparatus, the multiple discharge heads including the specific discharge head may be provided along a first direction. The control unit may perform a first step in which the discharge head arranged in a more downstream side of the first direction than the specific discharge head is arranged, while transporting the recording medium along the first direction discharges the liquid, and then executes the image recording mode, a second step in which, after performing the first step, the reverse transportation mode is executed, and then the image formed in the first step is moved to a more upstream side of the first direction than the specific discharge head is arranged, and a third step in which, after performing the second step, the specific discharge head discharges the liquid onto the image formed in the first step while transporting the recording medium along the first direction, and then executing the image recording mode.

With this configuration, the multiple discharge heads including the specific discharge head are provided along the first direction that is the transportation direction of the recording medium in the image recording mode. Then, the first step in which the image is recorded on the recording medium using the discharge head arranged in the more downstream side of the first direction than the specific discharge head, and the third step in which the specific discharge head discharges the liquid onto the image formed in the first step to record the image are performed. In other words, in the third step, the image is recorded in such a manner as to be superimposed on the image recorded in the first step.

At this time, in the first step, the image is recorded using the discharge head that is in the more downstream side of the first direction than the specific discharge head that records the image in the third step. Therefore, in the third step, in order for the specific discharge head to record the image in such a manner as to be superimposed on the image whose recording has been completed in the first step, it is necessary to move the image recorded in the first step in advance to the more upstream side of the first direction than the specific discharge head is arranged.

Therefore, with this configuration, the reverse transportation mode is executed before the third step (the second step). Besides, since the amount of transportation of the recording medium in the reverse transportation mode is precisely controlled based on the result of detection by the rotational position detection unit, the recording medium can be precisely transported to the appropriate position for the image recording mode being executed in the third step. As a result, the image being recorded in the third step can be precisely superimposed with respect to the image whose recording has been completed in the first step.

At this time, in the image recording apparatus, the recording medium may have optical transparency, and the specific discharge head may discharge the white liquid onto the recording medium. With this configuration, for example, the white image can be recorded in the third step, as the background image of the image recorded in the first step.

Furthermore, in the image recording apparatus, the transportation unit may have a releasing unit that releases the recording medium from a winding shaft around which the recording medium is wound up, and a drive roller, which is arranged between the releasing unit and the driven drum, and transports the recording medium released by the releasing unit toward the first direction, and the control unit may control torque of the drive roller is controlled in such a manner that tension of the recording medium, which is wound onto the driven drum that is in the more downstream side of the first direction than the drive roller, is greater than tension of the recording medium that is in the more upstream side of the first direction than the drive roller.

With this configuration, along the first direction that is the transportation direction of the recording medium in the image recording mode, the torque of the drive roller is controlled in such a manner that the tension of the recording medium that is in the more downstream side than the drive roller is greater than the tension of the recording medium that is in the more upstream side than the drive roller. Therefore, since the drive roller transports the recording medium along the first direction while generating braking torque, the transportation of the recording medium by the drive roller may be performed in a comparatively stable manner. As a result, the tension of the recording medium, which is transported by the drive roller and is wound onto the driven drum, can be stabilized. An occurrence of the slipping between the driven drum and the recording medium can be certainly suppressed, and this is advantageous in precisely controlling the amount of transportation of the recording medium.

Furthermore, in the image recording apparatus, the transportation unit may give the tension equivalent to the tension that is given to the recording medium in the image recording mode to the recording medium in the reverse transportation mode. As a result, the tension of the recording medium, which is wound onto the driven drum, can be stabilized. The occurrence of the slipping between the driven drum and the recording medium can be certainly suppressed, and this is advantageous in precisely controlling the amount of transportation of the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
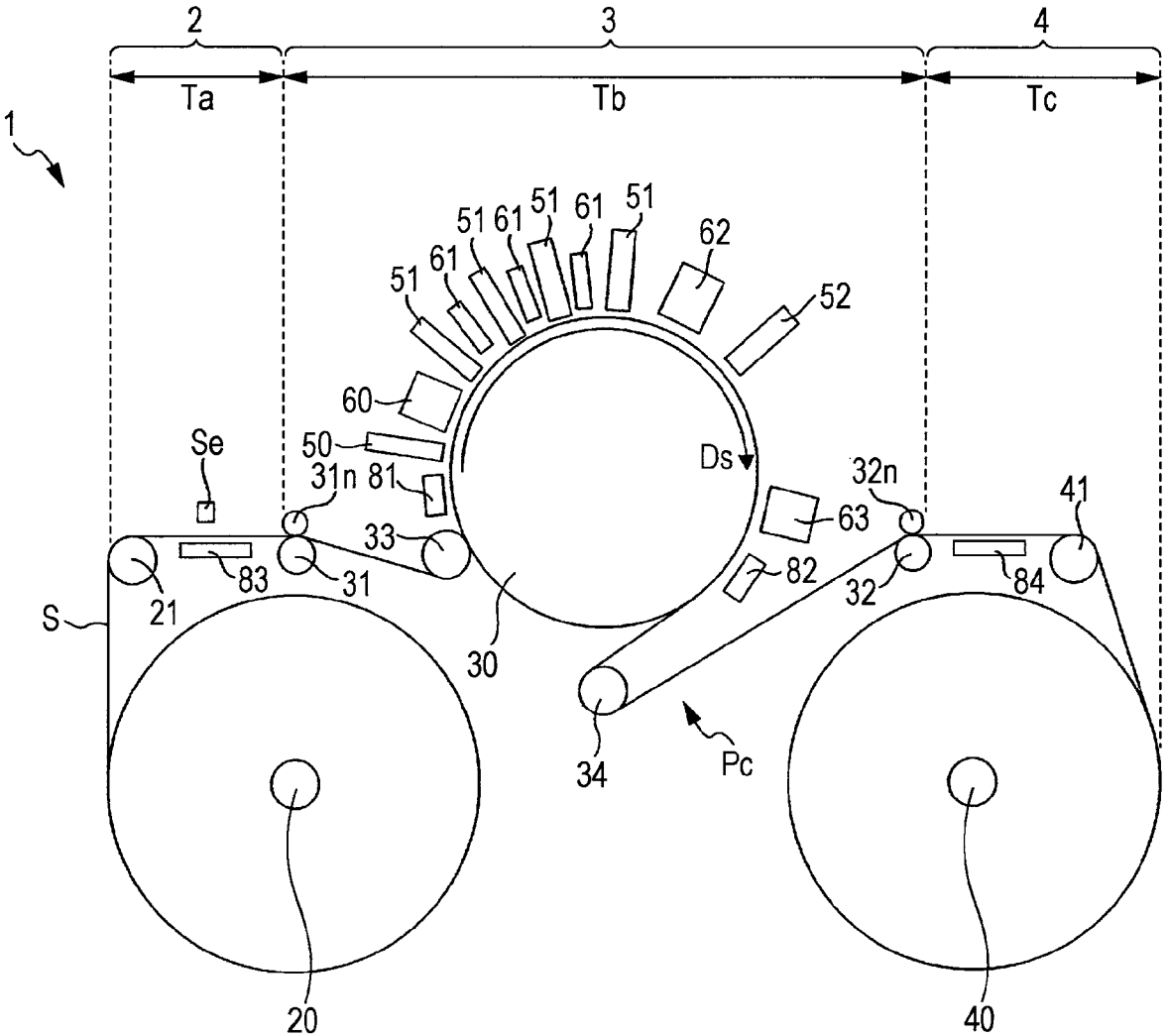
FIG. 1 is a view schematically illustrating one example of a device configuration employed by a printer to which the invention is applicable.

FIG. 1 is a front view schematically illustrating one example of a device configuration employed by a printer to which the invention is applicable. As illustrated in FIG. 1, in both ends of a printer 1, one sheet S (a web) that is wound up around a releasing shaft 20 and a winding shaft 40 in the form of a roll is stretched between the releasing shaft 20 and the winding shaft 40, and the sheet S is transported from the releasing shaft 20 to the winding shaft 40 along a path Pc that is stretched in this manner. Then, in the printer 1, an image is recorded with respect to the sheet S transported along the transportation path Pc. A type of the sheet S is broadly categorized into a paper system and a film system. There are premium grade paper, cast paper, art paper, and coated paper in the paper system, and there are synthetic paper, polyethylene terephthalate (PET), and polypropylene (PP) in the film system, to name specific examples. Generally, the printer 1 includes a releasing unit 2 that releases the sheet S from the releasing shaft 20, a process unit 3 that records the image onto the sheet S released from the releasing unit 2, and a winding unit 4 that winds up the sheet S, on which the image is recorded in the process unit 3, around the winding shaft 40. Moreover, in the following description, of both sides of the sheet S, the side on which to record the image is referred to as a surface and the opposite side thereof is a rear surface.

An exit unit 2 has the releasing shaft 20 around which an end of the sheet S is wound up, and a driven roller 21 onto which the sheet S stretched from the releasing shaft 20 is wound. The end of the sheet S is supported by being wound up around the releasing shaft 20 in a state where the surface of the sheet S faces toward the outside. Then, clockwise rotation of the releasing shaft 20 in FIG. 1 releases the sheets S, wound up around the releasing shaft 20, to the process unit 3 via the driven roller 21. Incidentally, the sheet S is wound up around the releasing shaft 20 via a core pipe (an illustration thereof is omitted) attachable to and detachable from the releasing shaft 20. Therefore, when the sheet S on the releasing shaft 20 is used up, the sheet S on the releasing shaft 20 can be replaced by attaching a new core pipe, around which the sheet S is wound up in the form of a roll, to the releasing shaft 20.

The process unit 3 appropriately performs the processing using function parts 50, 51, 52, 60, 61, 62, and 63 that are arranged along the peripheral surface of a platen drum 30, while supporting the sheet S released from the releasing unit 2 with the platen drum 30, and thus records the image onto the sheet S. In the process unit 3, a front drive roller 31 and a rear drive roller 32 are provided on both sides of the platen drum 30, respectively, and the sheet S transported from the front drive roller 31 to the rear drive roller 32 is supported by the platen drum 30 to receive the image recording.

The front drive roller 31 has multiple microscopic protrusions, formed using the thermal spraying, on the peripheral surface. The sheet S, released from the releasing unit 2, is wound onto the front drive roller 31, beginning with the rear surface. Then, clockwise rotation of the front drive roller 31 in FIG. 1 transports the sheet S, released from the releasing unit 2, to a downstream side of the transportation path Pc. Moreover, a nip roller 31*n* is provided with respect to the front drive roller 31. The nip roller 31*n* is in contact with the surface of the sheet S in a state where the feed roller 31*n* is forced to the side of the front drive roller 31 and interposes the sheet S between the feed roller 31*n* and the front drive roller 31. When this is done, a frictional force is ensured between the front drive roller 31 and the sheet S, and the transportation of the sheet S by the front drive roller 31 may certainly be performed.

The platen drum 30 is a cylindrical drum supported rotatably by a support mechanism of which an illustration is omitted. The sheet S, which is to be transported from the front drive roller 31 to the rear drive roller 32, is wound up around the platen drum 30, beginning with the rear surface. The platen drum 30 supports the sheet S, beginning with the rear surface, while rotating as a result of receiving the frictional force between the platen drum 30 and the sheet S and thus being driven along a transportation direction Ds of the sheet S. Incidentally, in the process unit 3, the driven rollers 33 and 34 are provided that fold the sheet S back in both sides of a winding unit for performing the winding around the platen drum 30. The surface of the sheet S is wound onto the driven roller 33 of these, between the front drive roller 31 and the platen drum 30, and thus the sheet S is folded back. On the other hand, the surface of the sheet S is wound onto the driven roller 34 between the platen drum 30 and the rear drive roller 32, and thus the sheet S is folded back. In this manner, the winding unit for performing winding around the platen drum 30 may be secured for a long time by folding the sheet S back in both of the upstream and downstream sides of the transportation direction Ds with respect to the platen drum 30.

The rear drive roller 32 has the multiple microscopic protrusions, formed using the thermal spraying, on the peripheral surface, and the sheet S, transported from the platen drum 30 via the driven roller 34, is wound onto the rear drive roller 32, beginning with the rear surface. Then, the rear drive roller 32 rotates in the clockwise direction in FIG. 1 and thus transports the sheet S to the winding unit 4. Moreover, the feed roller 32*n* is provided with respect to the rear drive roller 32. The feed roller 32*n* is in contact with the surface of the sheet S in a state where the feed roller 32*n* is forced to the side of the rear drive roller 32 and interposes the sheet S between the feed roller 32*n* and the rear drive roller 32. When this is done, the frictional force is ensured between the rear drive roller 32 and the sheet S, and the transportation of the sheet S by the rear drive roller 32 may certainly be performed.

In this manner, the sheet S, transported to the rear drive roller 32 from the front drive roller 31, is supported by the peripheral surface of the platen drum 30. Then, the printer 1 may form a color image with a white background image on the surface of the sheet S supported by the peripheral surface of the platen drum 30, using multiple recording heads 50 and 51 that are in parallel with each other along the transportation direction Ds.

Specifically, of the multiple recording heads 50 and 51, the recording head 50 positioned in the uppermost upstream side of the transportation direction Ds corresponds to white. The recording head 50 faces toward the surface of the sheet S wound up around the platen drum 30, with some clearance provided between the recording head 50 and the surface of the sheet S, and discharges a white ink through a nozzle using an ink jet method. Then, the recording head 50 discharges the ink with respect to the surface of the sheets S that is to be transported along the transportation direction Ds to form the white background image. Moreover, the white background image is formed when using the sheet S that belongs to an optical transparency film system, and may be omitted when using the sheet S that belongs to a paper system, white in paper color.

On the other hand, the multiple recording heads 51, arranged with respect to the recording head 50 for white in the downstream side of the transportation direction Ds, correspond to colors different from each other, and cooperate to form the color image. Specifically, the four recording heads 51, which correspond to yellow, cyan, magenta and black, are in parallel with each other in this sequence of colors, along the transportation direction Ds. Each recording head 51 faces toward the surface of the sheet S wound up around the platen drum 30, with some clearance provided between the recording head 51 and the surface of the sheet S, and discharges the ink in the corresponding color through the nozzle using the ink jet method. Then, each recording head 51 discharges the ink with respect to the surface of the sheets S being transported along the transportation direction Ds and thus forms the color image in such a manner as to be superimposed on the white background image.

Incidentally, an ultra violet (UV) ink (a photo-hardened ink) that, when is exposed to an ultraviolet ray (light), is hardened is used as the ink that is to be discharged by the recording heads 50 and 51. Therefore, UV lamps 60, 61, and 62 (light emitting units) are provided in the process unit 3 in order to harden the ink and fix it to the sheet S. Specifically, the UV lamp 60 is arranged between the recording head 50 for white and the recording head 51 for color. Then, the UV lamp 60 emits the strong ultraviolet ray and thus completely hardens the white ink, discharged by the recording head 50 (primary hardening). When this is done, the white background image, formed by the recording head 50, may be fixed to the surface of the sheet S.

Furthermore, the ink hardening is performed also on the ink discharged by the recording head 51 for color. Moreover, the ink hardening is performed in two phases, temporary hardening and the primary hardening. Specifically, the UV lamp 61 for the temporary hardening is arranged between the multiple recording heads 51. In other words, by emitting the weak ultraviolet ray, the UV lamp 61 hardens the ink to an extent that a shape of the ink does not collapse (the temporary hardening), without completely hardening the ink. On the other hand, the UV lamp 62 for the primary hardening is provided in the downstream side of the transportation direction Ds with respect to the multiple recording heads 51. In other words, by emitting the stronger ultraviolet ray than does the UV lamp 61, the UV lamp 62 completely hardens the ink (the primary hardening). The color image, formed by the multiple recording heads 51, may be fixed to the surface of the sheet S by performing the temporary hardening and the primary hardening in this sequence in this manner.

Furthermore, the recording head 52 is provided in the downstream side of the transportation direction Ds with respect to the UV lamp 62. The recording head 52 faces toward the surface of the sheet S wound up around the platen drum 30, with some clearance provided between the recording head 52 and the surface of the sheet S, and a transparent UV ink is discharged through the nozzle onto the surface of the sheet S using the ink jet method. In other words, the transparence ink is further discharged with respect to the color image that is formed by the recording heads 50 and 51 and has the white background image. Furthermore, the UV lamp 63 is provided with respect to the recording head 52, in the downstream side of the transportation direction Ds. The UV lamp 63 emits the strong ultraviolet ray and thus completely hardens the transparent ink, discharged by the recording head 52 (the primary hardening). When this is done, the transparent ink may be fixed to the surface of the sheet S.

In this manner, in the process unit 3, the discharging and the hardening of the ink are appropriately performed with respect to the sheet S that is wound up around the peripheral portion of the platen drum 30, and the color image is formed that is coated with the transparent ink and has the white background image. The sheet S on which the image is formed in this manner is transported to the winding unit 4 by the rear drive roller 32.

In addition to the winding shaft 40 around which the end of the sheet S is wound up, the winding unit 4 has a driven roller 41 onto which the sheet S is wound between the winding shaft 40 and the rear drive roller 32, beginning with the rear surface. The winding shaft 40 provides support by winding the end of the sheet S up around the winding shaft 40, in a state where the surface of the sheet S faces toward the outside. In other words, when the winding shaft 40 rotates in the clockwise direction in FIG. 1, the sheet S, transported from the rear drive roller 32, is wound up around the winding shaft 40 via the driven roller 41. Incidentally, the sheet S is wound up around the winding shaft 40 via the core pipe (an illustration thereof is omitted) that is attachable to and detachable from the winding shaft 40. Therefore, when the sheet S wound up around the winding shaft 40 is wound to the full degree of length, removal of the sheet S is made possible from every core pipe.

Furthermore, in addition to the function parts described above, a foreign material sensor 81, an image tester 82, and splice tables 83 and 84 are provided in the printer 1. In the more upstream side of the transportation direction Ds than the recording head 50 is arranged, the foreign material sensor 81 faces toward the winding unit that winds the sheet S up around the platen drum 30 and detects a foreign material attached to the surface of the sheet S. The image tester 82 faces toward the winding unit that winds the sheet S up around the platen drum 30, in the downstream side of the transportation direction Ds of the UV lamp 63, and is a scanner that reads the image formed by the recording heads 50 and 51. The image tester 82 is used to detect dot omission that occurs in the image, as described below. In the releasing unit 2, a splice table 83 cuts the sheet S between the driven roller 21 and the front drive roller 31, and for example, is used to cut the sheet S when the core pipe is removed from the releasing shaft 20. In the releasing unit 4, a splice table 84 cuts the sheet S between the driven roller 41 and the rear drive roller 32, and for example, is used to cut the sheet S when the core pipe is removed from the releasing shaft 40.

Figure 2:
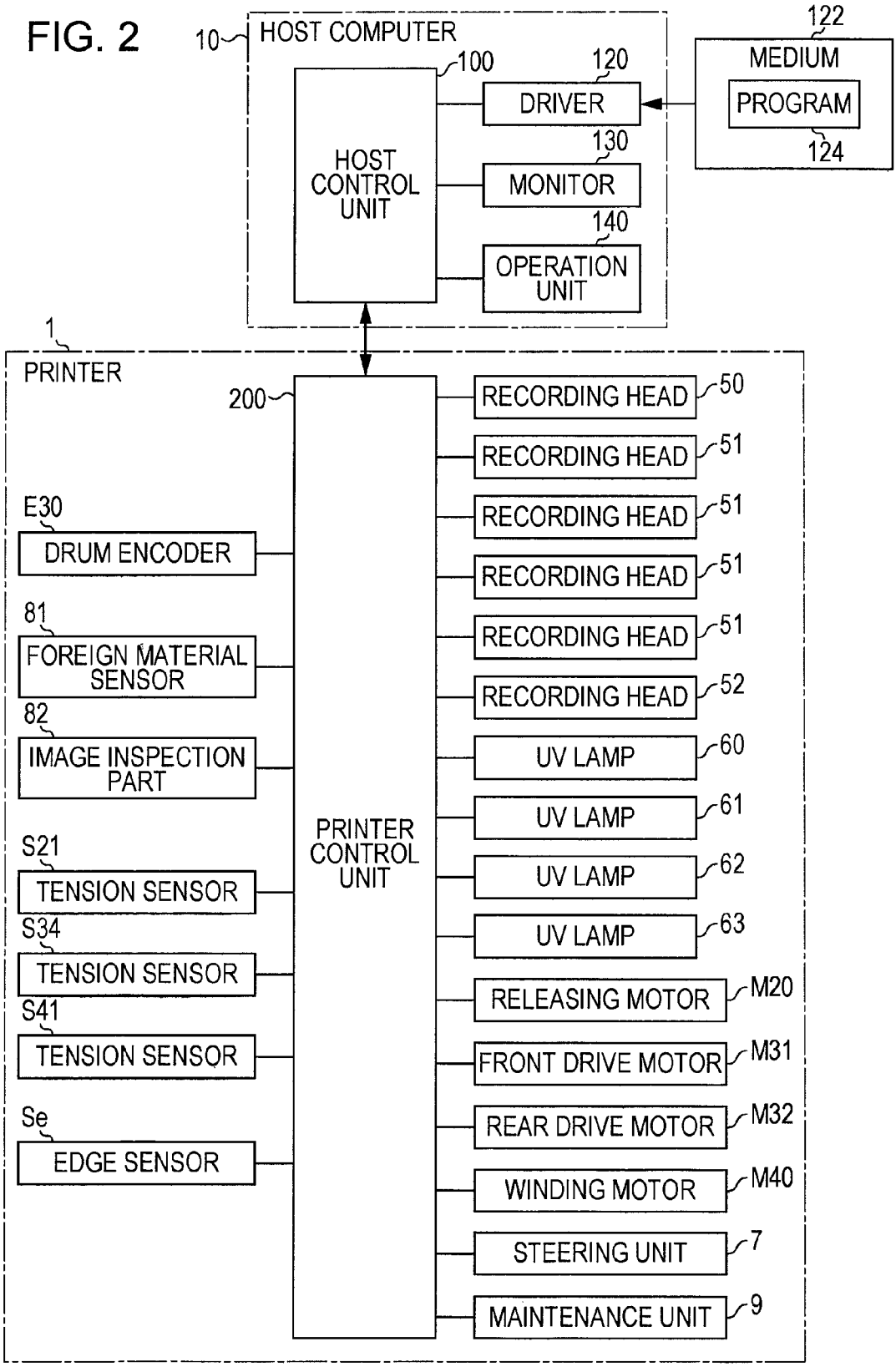
FIG. 2 is a view schematically illustrating an electrical configuration in which the printer, illustrated in FIG. 1 is controlled.

What is described above is the device configuration of the printer 1. Subsequently, an electrical configuration is described in which the printer 1 is controlled. FIG. 2 is a view schematically illustrating the electrical configuration in which the printer, illustrated in FIG. 1, is controlled. Operation of printer 1 described above is controlled by a host computer 10 illustrated in FIG. 2. In the host computer 10, a host control unit 100 that governs the control operation is configured from a central processing unit (CPU) and a memory. Furthermore, a driver 120 is provided in the host computer 10, and the driver 120 reads a program 124 from a medium 122. Moreover, various media, such as a compact disk (CD), a digital versatile disk (DVD), and a universal serial bus (USB) memory may be used as the medium 122. Then, the host control unit 100 performs control of each unit of the host computer 10 and control of operation of the printer 1, based on the program 124 read from the medium 122.

Additionally, a monitor 130, configured from a liquid crystal display and the like, and an operation unit 140, configured from a keyboard, a mouse and the like are provided in the host computer 10, as an interface with an operator. In addition to a printing-targeted image, a menu screen is displayed on the monitor 130. Therefore, the operator may operate the operation unit 140 while checking the monitor 130, Accordingly, the operator may set various printing conditions, such as a type of printing medium, a size of printing medium, a print quality, and the like, while viewing a print setting screen from the menu screen. Moreover, various modifications may be made with respect to a specific configuration of the interface with the operator, and for example, a touch panel type display may be used as the monitor 130, and the operation unit 140 may be configured from the touch panel of the monitor 130.

On the other hand, in the printer 1, a printer control unit 200 is provided that controls each unit of the printer 1 according to a command from the host computer 10. Then, the recording head, the UV lamp and the members of the sheet transportation system are controlled by the printer control unit 200. A detail of the control of the members by the printer control unit 200 is as follows.

The printer control unit 20Q controls a timing when each of the recording heads 50 and 51 forming the image discharge the ink, according to the transportation of the sheet S. Specifically, the control of this ink discharge timing is performed based on an output (a detection value) of a drum encoder E30 that is attached to the rotation shaft of the platen drum 30, and detects the rotational position of the platen drum 30. In other words, since the platen drum 30 rotates as a result of being driven depending on the transportation of the sheet S, a transformational position of the sheet S may be grasped when referring to the output of the drum encoder E30 detecting the rotational position of the platen drum 30. Accordingly, the printer control unit 200 generates a print-timing-signal (pts) signal from the output of the drum encoder E30, and controls the timing when each of the recording heads 50 and 51 discharges the ink, based on the pts signal. Thus, the landing of the ink discharged by each recording head 51 onto a target position on the sheet S being transported results in formation of the image.

Furthermore, the timing when the recording head 52 discharges the transparent ink is also controlled by the printer control unit 200 in the same manner, based on the output of the drum encoder E30. When this is done, the transparent ink may be precisely discharged with respect to the image formed by the multiple recording heads 50 and 51. Furthermore, also timings when the UV lamps 60, 61, 62, and 63 turn on and off, and an amount of emission light are controlled by the printer control unit 200.

Furthermore, the printer control unit 200 governs a function of controlling the transportation of the sheet S, described using FIG. 1. In other words, among the members making up the sheet transportation system, a motor is connected to each of the releasing shaft 20, the front drive roller 31, the rear drive roller 32 and the winding shaft 40. Then, the printer control unit 200 controls the transportation of the sheet S by controlling a speed and a torque of each motor while rotating the motors. A detail of the transportation control of the sheet S is as follows.

The printer control unit 200 rotates a releasing motor M20 that drives the releasing shaft 20, and thus supplies the sheet S from the releasing shaft 20 to the front drive roller 31. At this time, the printer control unit 200 controls the torque of the releasing motor M20, and thus adjusts the tension (releasing tension Ta) of the sheet S from the releasing shaft 20 to the front drive roller 31. In other words, a tension sensor S21 that detects the releasing tension Ta is attached to the driven roller 21 arranged between the releasing shaft 20 and the front drive roller 31. The tension sensor S21, for example, may be configured from a load cell that detects a force that is received from the sheet S. Then, the printer control unit 200 feedback-controls the torque of the releasing motor M20, and thus adjusts the releasing tension Ta of the sheet S, based on a result of the detection by the tension sensor S21.

At this time, the printer control unit 200 performs the releasing on the sheet S while adjusting a position of the width direction (the direction perpendicular to the sheet of paper on which FIG. 1 is drawn) of the sheet S that is supplied from the releasing shaft 20 to the front drive roller 31. In other words, a steering unit 7 that displaces each of the releasing shaft 20 and the driven roller 21 in the shaft direction (in other words, in the width direction of the sheet S) is provided in the printer 1. Furthermore, an edge sensor Se that detects an edge of the sheet S in the width direction of the sheet S is arranged between the driven roller 21 and the front drive roller 31. The edge sensor Se, for example, may be configured from a distance sensor such as an ultrasonic sensor. Then, the printer control unit 200 feedback-controls the steering unit 7, and thus adjusts the position of the sheet S in the width direction, based on a result of the detection by the edge sensor Se. When this is done, the position of the sheet S in the width direction becomes appropriate, and thus a transportation defect is suppressed, such as a meander of the sheet S.

Furthermore, the printer control unit 200 rotates a front drive motor M31 that drives the front drive roller 31 and a rear drive motor M32 that drives the rear drive roller 32. When this is done, the sheet S, released from the releasing unit 2, passes the process unit 3. At this time, torque control is performed with respect to the rear drive motor M32 while speed control is performed with respect to the front drive motor M31. In other words, the printer control unit 200 constantly adjusts the rotational speed of the front drive motor M31, based on the encoder output of the front drive motor M31. When this is done, the sheet S is transported by the front drive roller 31 at a constant speed.

On the other hand, the printer control unit 200 controls the torque of the rear drive motor M32, and thus adjusts the tension (process tension Tb) of the sheet S from the front drive roller 31 to the rear drive roller 32. In other words, a tension sensor S34 that detects the process tension Tb is attached to the driven roller 34 arranged between the platen drum 30 and the rear drive roller 32. The tension sensor S34, for example, may be configured from the load cell that detects a force being received from the sheet S. Then, the printer control unit 200 feedback-controls the torque of the rear drive motor M32, and thus adjusts the process tension Tb of the sheet S, based on a result of the detection by the tension sensor S34.

Furthermore, the printer control unit 200 rotates a winding motor M40 that drives the winding shaft 40, and thus the sheets S, transported by the rear drive roller 32, is wound up around the winding shaft 40. At this time, the printer control unit 200 controls the torque of the winding motor M40, and thus adjusts the tension (winding tension Tc) of the sheet S from the rear drive roller 32 to the winding shaft 40. In other words, a tension sensor S41 that detects the releasing tension Tc is attached to the driven roller 41 arranged between the rear drive roller 32 and the winding shaft 40. The tension sensor S41, for example, may be configured from the load cell that detects the force being received from sheet S. Then, the printer control unit 200 feedback-controls the torque of the winding motor M40, and thus adjusts the winding tension Tc of the sheet S, based on a result of the detection by the tension sensor S41.

In this manner, the printer control unit 200 performs the image recording on the sheet S while performing a forward transportation operation in which the sheets S are transported in a forward direction Df of the transportation path Pc (equivalent to the transportation direction Ds) by controlling motors M20, M31, M32, and M40 (image recording mode). Furthermore, in addition to the forward transportation operation, the printer control unit 200 may appropriately perform a reverse transportation operation in which the sheet S is transported in a direction Db opposite to the transportation path Pc (equivalent to a direction opposite to the transportation direction Ds) (reverse transportation mode). At this time, a setting is provided in such a manner that the tension Tb given to the sheet S on the process unit 3 during the forward transportation operation and the tension Tb given to the sheet S on the process unit 3 during the reverse transportation operation are equal to each other.

Then, the printer control unit 200 controls the amount of transportation of the sheet S during each of the forward transportation operation and the reverse transportation operation. According to this embodiment, the amount of transportation of the sheet S is controlled during each of the forward transportation operation and the reverse transportation operation, based on the result of the drum encoder E30 detecting the rotational position of the platen drum 30.

Furthermore, the printer control unit 200 controls a transportation system of the printer 1, based on a result of the detection by the foreign material sensor 81. In other words, when the foreign material sensor 81 detects a foreign material on the surface of the sheet S while executing the image recording mode, the printer control unit 200 stops the transportation of the sheet S and thus interrupts the image recording mode, and performs an indication of removal of the foreign material on the monitor 130. The foreign material attached to the sheet S may be prevented from coming into contact with the recording heads 50, 51, and 52, and thus causes damage to these, by stopping the transportation of the sheet S in this manner. Furthermore, by checking the monitor 130 for the indication, the operator may perform the appropriate maintenance to remove the foreign material. Then, when the effect that the removal of the foreign material is completed is input to the host computer 10 via the operation unit 140, the printer control unit 200 starts the transportation of the sheet S and resumes the image recording mode.

Furthermore, the printer control unit 200 controls the transportation system of the printer 1, based on a result of the reading of the image by the image tester 82. Specifically, whenever the image tester 82 completes the reading of a predetermined unit of the image, the printer control unit 200 compares image data with the read image and checks whether or not the dot omission is present the read image. At this point, the image data are data that indicate the image that has to be formed, and is created by the host computer 10. Then, when the dot omission is detected while executing the image recording mode, the printer control unit 200 interrupts the image recording mode by stopping the transportation of the sheet S and performs the maintenance to clean the nozzles of the recording heads 50, 51, and 52. Thus, clogging of the nozzle, which is a cause for the dot omission, may be solved.

Moreover, the maintenance unit 9 performs the maintenance on the recording heads 50, 51 and 52. The maintenance unit 9 of which an illustration is omitted in FIG. 1 is arranged in a position that is out of the drum shaft direction (that is, the direction perpendicular to the sheet of paper on which FIG. 1 is drawn) from the platen drum 30. Therefore, the recording heads 50, 51, and 52 move from the platen drum 30 to the maintenance unit 9 along the drum shaft direction and receive the maintenance by the maintenance unit 9. Then, when the maintenance is completed, the printer control unit 200 returns the recording heads 50, 51, and 52 to a position that faces toward the platen drum 30, and resumes the transportation of the sheet S.

Figure 3:
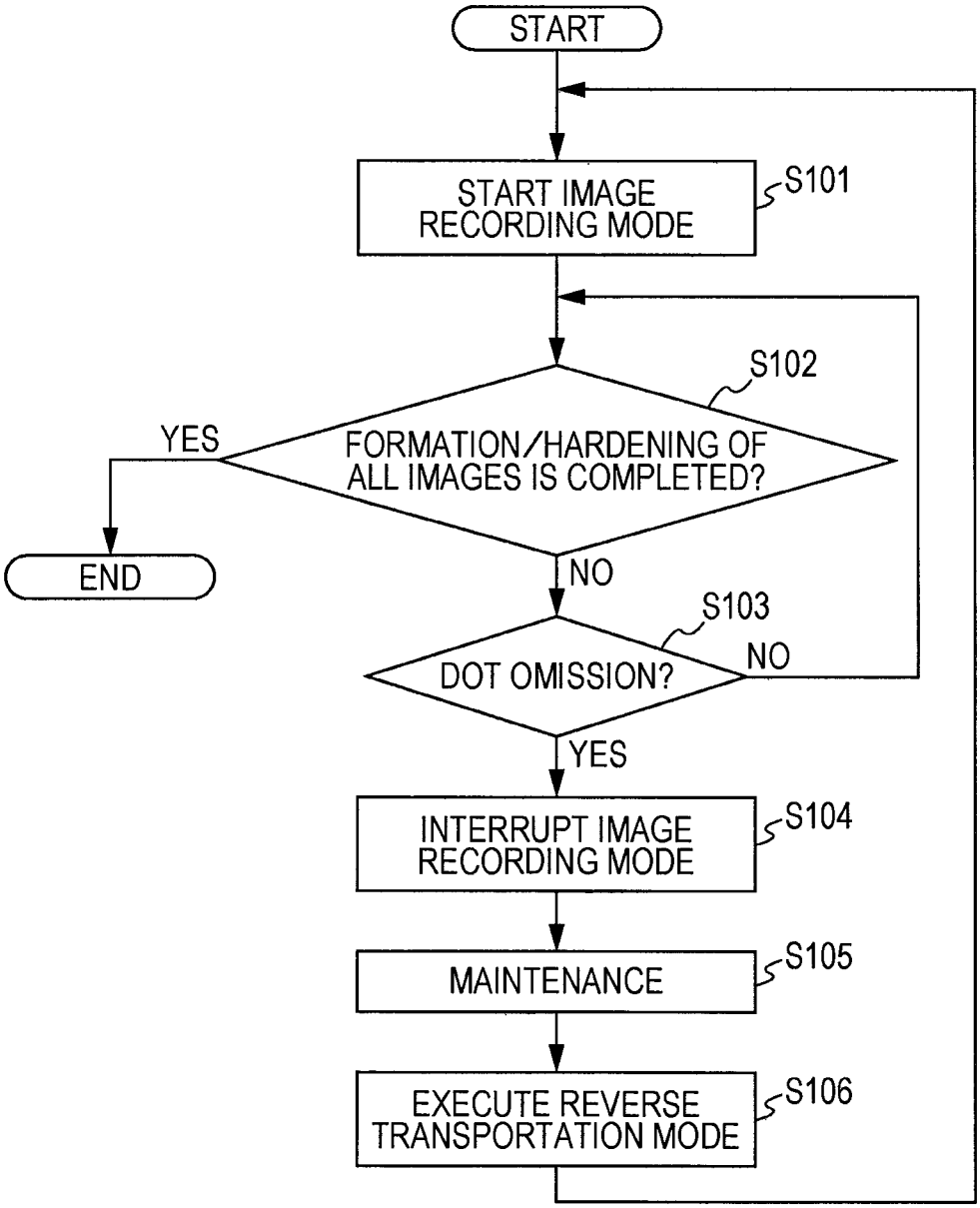
FIG. 3 is a flowchart illustrating an example of operation of the printer according to a first embodiment.
Figure 4:
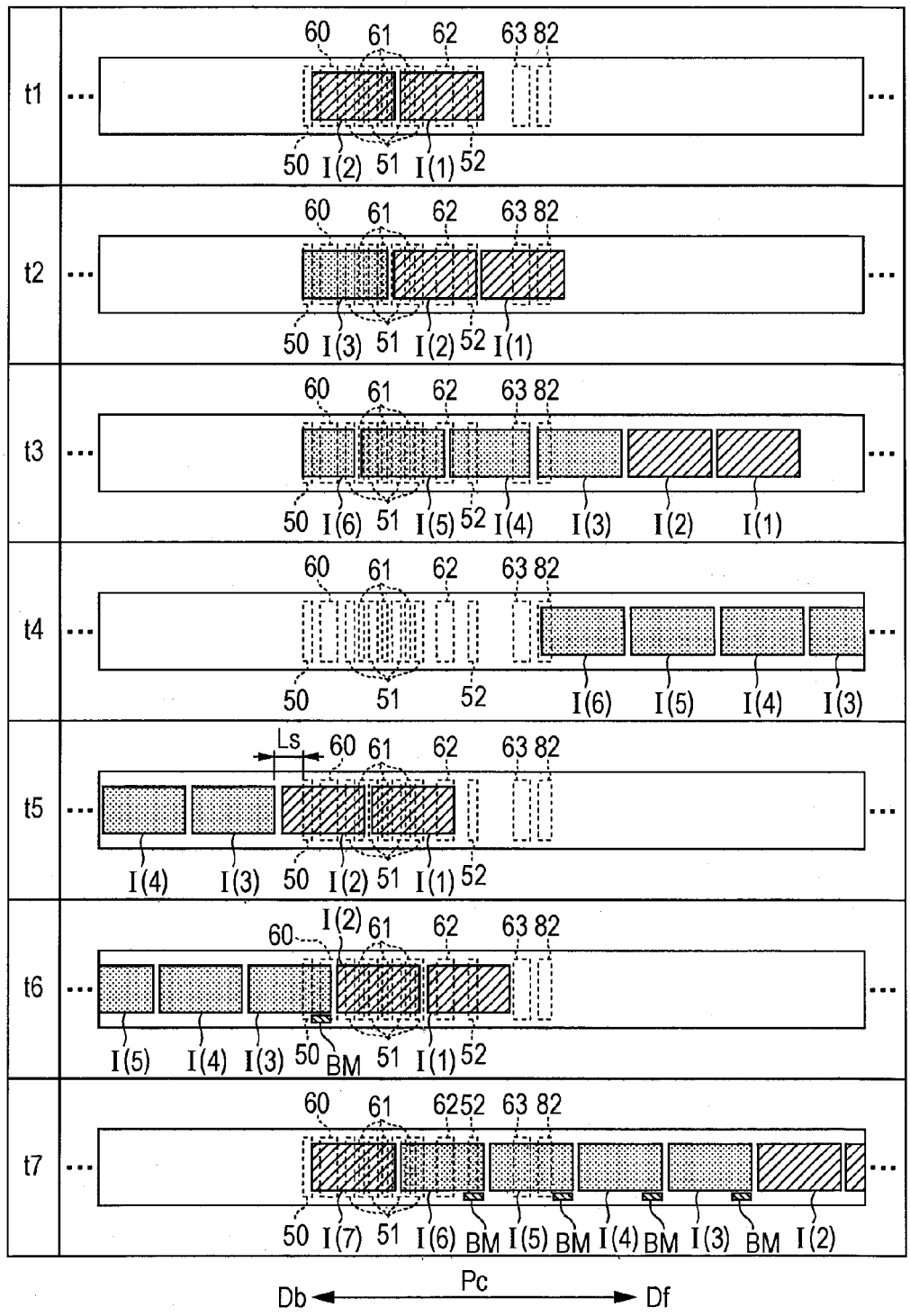
FIG. 4 is a view illustrating one operation that is performed according to the flowchart in FIG. 3.

What is described above is an outline of the electrical configuration in which the printer 1 is controlled. Subsequently, an operational example of the printer 1 that operates according to the first embodiment is described. Particularly, according to the first embodiment, the operation in a case where the image tester 82 detects the dot omission is described referring to FIG. 3 and FIG. 4. FIG. 3 is a flowchart illustrating an operational example of the printer according to a first embodiment. The flowchart in FIG. 3 is incorporated in the program 124 and is performed by the printer control unit 200. FIG. 4 is a view illustrating one operation that is performed according to the flowchart in FIG. 3 and illustrates the operation of the printer 1 in points at time t1 to t7 in an unfolding manner along the transportation path Pc. Furthermore, in FIG. 4, each of the function parts 50 to 52, 60 to 63, and 82 is indicated by a broken line, and hatching made from multiple slanted lines is performed on a normal image without any dot omission, and hatching made from multiple points is performed on an aberration image with the dot omission.

In Step S101, the image recording mode is started. When this is done, the formation and the hardening of images I(1), I(2), and so forth to I(n) are sequentially performed with respect to the surface of the sheet S transported along the forward direction Df. Moreover, the images I(1), I(2), and so forth to I(n) are images that result from the color images being superimposed on the white background images and further from the superimposed images being coated with clear inks. In Step S102 that follows, it is determined whether or not the formation and the hardening of all of the images I(1), I(2), and so forth to I(n), which are prearranged, are completed. In a case where the formation and the hardening of all of the images I(1), I(2), and so forth to I(n) are completed (in a case where the result is "YES" in Step S102), the flowchart in FIG. 3 is ended. On the other hand, in a case where the formation and the hardening of all of the images I(1), I(2), and so forth to I(n) are not completed (in a case where the result is "NO" in Step S102), the proceeding to Step S103 takes place. In Step S103, it is checked whether or not the dot omission is detected by the image tester 82. Then, in a case where the dot omission is not detected, (in a case where the result is "NO" in Step S103), the turning back to Step S102 takes place, and on the other hand, in a case where the dot omission is detected (in a case where the result is "YES" in Step S103) the proceeding to Step S104 takes places.

In the operational example in FIG. 4, the images I(1) and I(2) are formed until the point in time t1 are the normal images without any dot omission. However, the clogging occurs in one of the recording heads 50, 51 and 52, between the points in time t1 and t2, and as a result, the image I(3) is the aberration image with the dot omission as illustrated in a section of a point in time "t2." However, the dot omission in the image I(3) is not detected because the image I(3) does not arrive at the image tester 82 at the point in time t2. Then, at a point in time t3 when the image tester 82 completes the reading of the image I(3) with the dot omission, the dot omission is detected by the image tester 82 (the result is "YES" in Step S103), and the proceeding to Step S104 takes place.

In Step S104, the image recording mode is interrupted. Furthermore, in the event that the image recording mode is interrupted, predetermined processing for interruption preparation is performed. Specifically, in order to complete the formation and the hardening of the images I(4) to I(6) of which the formation and the hardening are in progress at the point in time t3 when the dot omission is detected (in other words, in order to complete the processing until the primary hardening of the clear ink), the image recording mode continues for a period between the points in time t3 and t4 (the preparation processing for interruption). Then, the image recording mode is interrupted at the point in time t4 when the formation of the hardening of the image I(4) to I(6) are completed. Moreover, any one of the images I(4) to I(6) is the image that begins to be formed after the clogging of the nozzle occurs, and thus is the aberration image that has the dot omission.

When the image recording mode is interrupted in Step S104, the maintenance is performed on the recording heads 50, 51, and 52 in Step S105. Specifically, when it is confirmed that the transportation of the sheet S stopped, the recording heads 50, 51, and 52 move along the direction of the drum shaft of the platen drum 30, and thus the nozzle receives the cleaning by the maintenance unit 9. Then, when the cleaning is completed, the recording heads 50, 51, and 52 return to a position that faces toward the platen drum 30.

When it is confirmed that the maintenance is completed in Step S105, and the recording heads 50, 51, and 52 return to the position that faces toward the platen drum 30, Step S106 is performed. In Step S106, the reverse transportation mode is executed, and the sheet S is transported along the reverse direction Db only by a distance that results from adding a predetermined run-up distance Ls to the distance that the sheet S is transported for the period between the points in time t3 and t4. When this is done, the end of the forward direction Df of the image I(3) is positioned at a position that is only the run-up distance Ls away in the upstream side of the forward direction Df from the recording head 50 (a section of a point in time "t5" in FIG. 4).

When the reverse transportation mode in Step S106 is completed, the proceeding to Step S101 takes place and the image recording mode is resumed. In the resumed image recording mode, image quality information BM indicating that the image I(3) is the aberration image is aligned with the leading end position of the image I(3) and thus is formed on the lateral side of the image I(3). Moreover, as described above, by performing the reverse transportation mode in advance, a positional alignment is made between the leading end of the image I(3) and the recording heads 50, 51, and 52. Therefore, in the resumed image recording mode, the image quality information BM can be precisely formed in a predetermined position (a section of a point in time "t6" in FIG. 4). In the resumed image recording mode in succession to the formation of the image quality information BM on the image I(3), the image quality information BM indicating that the images I(4) to I(6) are the aberration images is formed to the lateral side of each the images I(4) to I(6), and in succession to this, new images I(7) and so forth to I(n) are formed (a section of a point in time "t7" in FIG. 4) Incidentally, the image quality information BM may be formed, for example, by hardening the black image formed by the recording head 51 for black using the UV lamp 62.

As described above, according to this embodiment, the platen drum 30 is provided that rotates as a result of being driven depending on the sheet S. The platen drum 30 may be rotated almost without the slipping with respect to the sheet S, because the platen drum 30 is driven by being left subject to the transportation of the sheet S while in contact with the sheet S, without giving the great drive force to the sheet S as does the transportation roller disclosed in JP-A-2001-054957. Therefore, the rotational position of the platen drum 30 appropriately reflects the amount of transportation of the sheet S. Therefore, according to this embodiment, the amount of transportation of the sheet S is controlled, based on a result of detecting the rotational position of the platen drum 30. When this is done, the amount of transportation of the sheet S can be precisely controlled.

Furthermore, according to this embodiment, the sheet S is wound up around the peripheral surface of the platen drum 30 and the frictional force is ensured between the platen drum 30 and the sheet S. As a result, the occurrence of the slipping may be certainly suppressed between the platen drum 30 and the sheet S, and this is advantageous in precisely controlling the amount of transportation of the sheet S.

Furthermore, according to this embodiment, the recording heads 50, 51, and 52 are provided that discharge the ink onto the surface of the sheet S to record the image. Furthermore, the sheet S is wound up around the platen drum 30, beginning with the rear surface, and this supports the sheet S. Then, the recording heads 50, 51, and 52 discharge the ink on the part of the sheet S, which is wound up around the platen drum 30 to form the image. Since the amount of transportation of the sheet S is detected with this configuration, the driven drum 30 performs not only the function of being driven depending on the sheet S, but also the function of supporting the sheet S onto which the discharge heads 50, 51, and 52 discharge the ink. For this reason, because it is not necessary to provide the member for every function, this is advantageous in suppressing the number of the members and thus accomplishes the minimization of the size of the printer 1.

Furthermore, according to this embodiment, in addition to the image recording mode, the reverse transportation mode can be executed. Therefore, by appropriately executing the reverse transportation mode, the sheet S may be transported to positions according to the operation that is performed in succession (for example, the resumed image recording mode in the example according to this embodiment). Besides, since the amount of transportation of the sheet S in the reverse transportation mode can be precisely controlled based on the result of detecting the rotational position of the platen drum 30, the sheet S may be precisely transported to the appropriate position for the operation that is performed in succession to the reverse transportation mode.

Furthermore, according to this embodiment, in a case where the aberration (the dot omission) occurs in the image recording mode that is being executed, the image recording mode is interrupted. Therefore, while the image recording mode is interrupted, for example, the maintenance necessary for solving the aberration (the nozzle cleaning) may be appropriately performed. Moreover, in a case where the image recording mode is interrupted in this manner, there are times when the positional alignment between the position of the sheet S at which the image recording starts and the discharge heads 50, 51, and 52 is necessary in the resumed image recording mode. Specifically, in the example in FIG. 4, the positional alignment is necessary between the leading end of the image I(3) and the recording heads 50, 51, and 52. In contrast, according to this embodiment, the positional alignment may be performed by executing the reverse transportation mode. Besides, since the amount of transportation of the sheet S in the reverse transportation mode can be precisely controlled based on the result of detecting the rotational position of the platen drum 30, the sheet S may be precisely transported to the appropriate position for the resumed image recording mode.

Furthermore, according to this embodiment, the aberration is detected that occurs in the image formed by the recording heads 50, 51, and 52. With this configuration, the image recording mode is interrupted in a case where the aberration in the image is detected. As a result, the further recording of the image with the aberration onto the sheet S may be suppressed and thus a waste of the sheet S may be suppressed.

Particularly, according to this embodiment, the defect in dot formation (the dot omission) is detected that occurs due to a defect in the ink discharged through the nozzles of the recording heads 50, 51, and 52. With this configuration, the further recording of the image with the defect in dot formation on the sheet S may be suppressed, and thus the waste of the sheet S may be suppressed.

Furthermore, according to this embodiment, during an interval from interrupting the image recording mode to resuming the image recording mode, the maintenance unit 9 performs the maintenance with respect to the nozzles of the recording heads 50, 51, and 52. With this configuration, in the resumed image recording mode, the appropriate image without any defect in dot formation may be recorded on the sheet S.

Furthermore, according to this embodiment, the tension Tb, equal to the tension Tb that is given to the sheet S in the image recording mode, is given to the sheet S in the reverse transportation mode. With this configuration, the tension Tb of the sheet S, which is wound onto the driven drum 30, may be stabilized. The occurrence of the slipping between the driven drum 30 and the sheet S may be certainly suppressed, and this is advantageous in precisely controlling the amount of transportation of the sheet S.

Second Embodiment

According to the first embodiment described above, a color image is formed in such a manner as to be superimposed on a white background image. However, while the color image is formed on the surface of a sheet S, the white background image may be formed in a superimposed manner. In other words, in a case where the image, visually recognized from the rear surface, is formed on the sheet S that belongs to a film system with optical transparency, the color image with the white background image may be formed by forming the image in this manner.

However, as described above, a recording head 50 for white is arranged in a more upstream side of a forward direction Df than a recording head 51 that forms the color image. Therefore, in order for the recording head 50 to superimpose the white background image while the recording head 51 forms the color image, it is necessary to reversely transport the color image, which has been formed, up to the upstream side of the forward direction Df of the recording head 50. Therefore, an operation according to a second embodiment is described. Moreover, a description is provided below with the focus being placed on differences from the first embodiment, and an appropriate description of features in common with the first embodiment is omitted. Moreover, it goes without saying that the employing of a configuration in common with the first embodiment results in the same effect.

Figure 5:
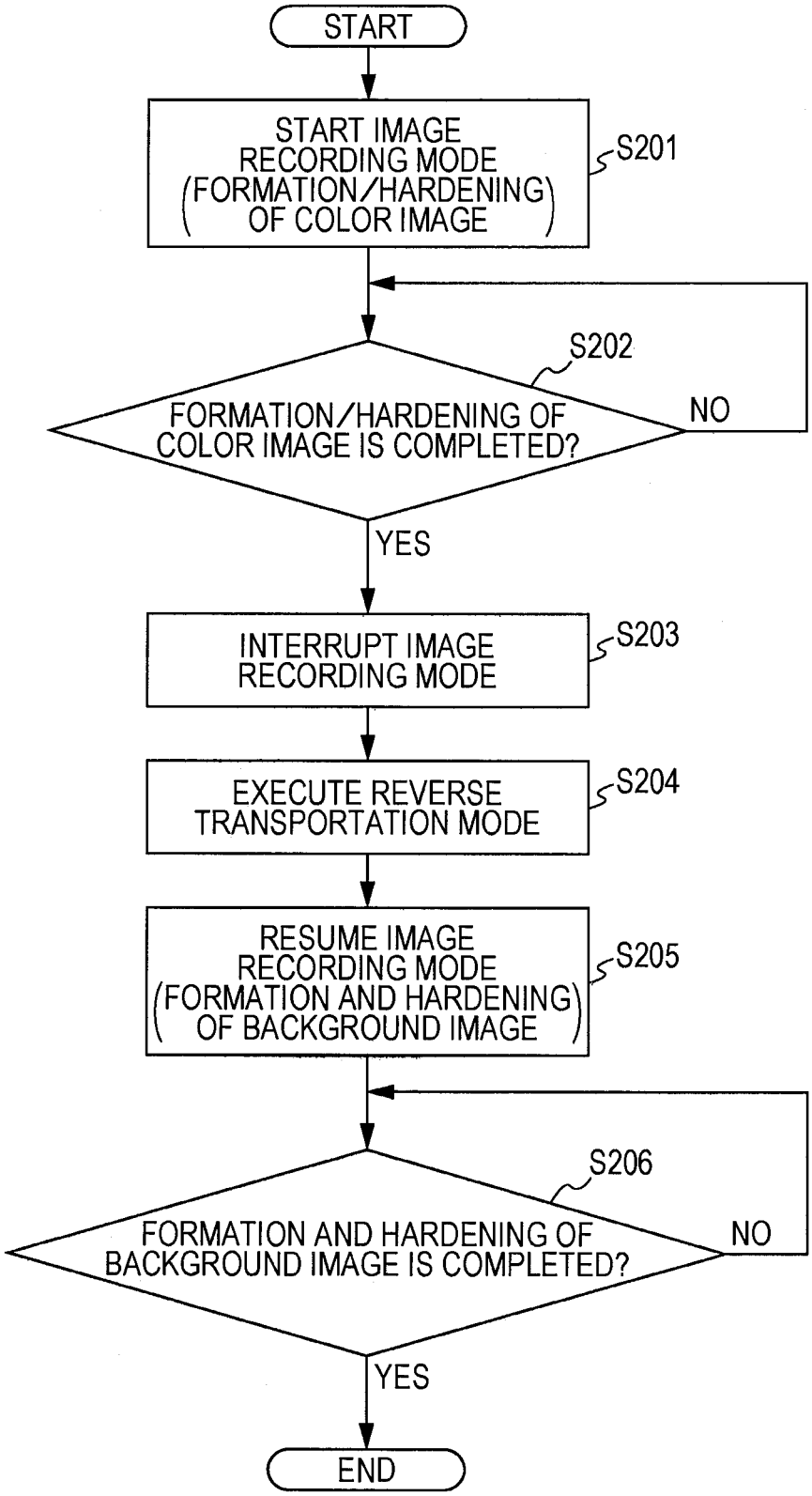
FIG. 5 is a flowchart illustrating an example of operation of the printer according to a second embodiment.
Figure 6:
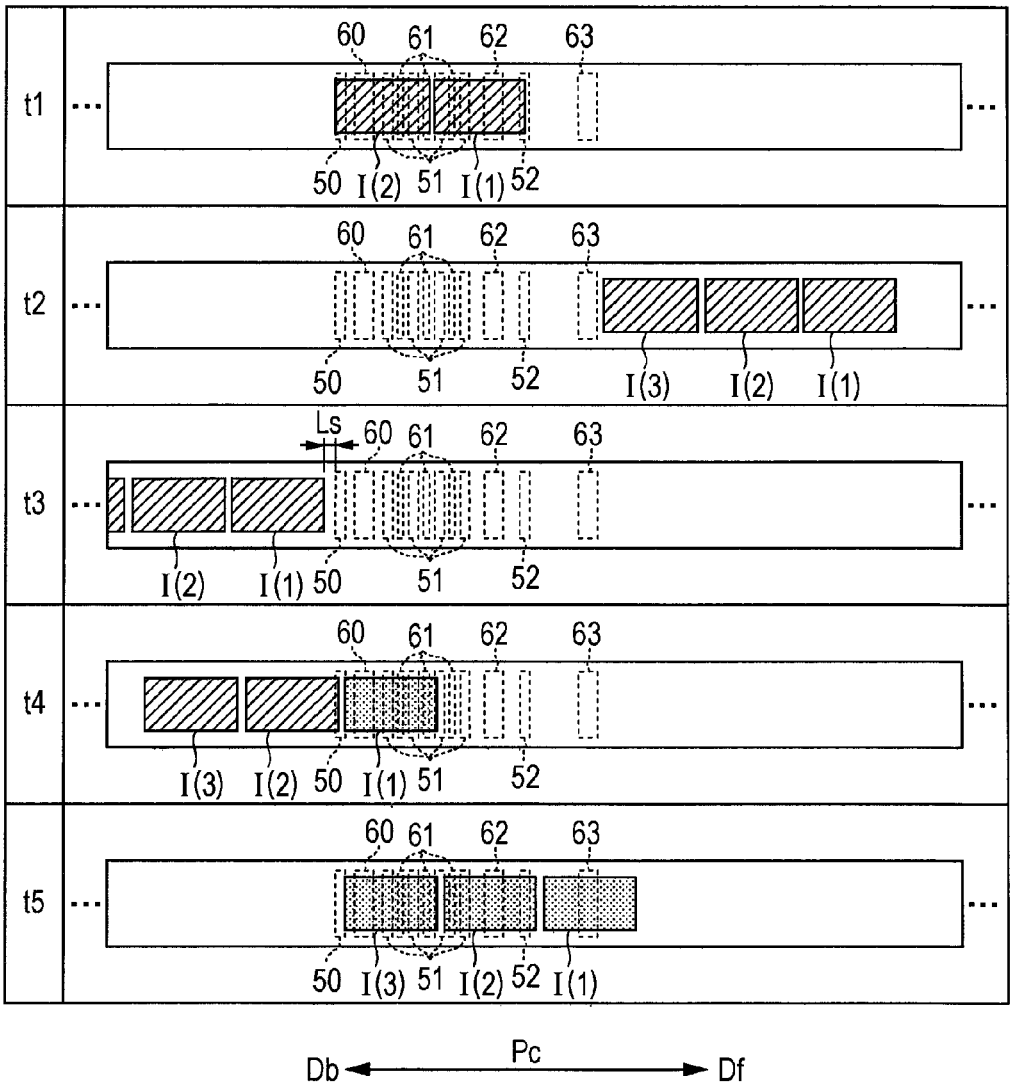
FIG. 6 is a view illustrating one operation that is performed according to the flowchart in FIG. 5.

FIG. 5 is a flowchart illustrating an operational example of a printer according to the second embodiment. The flowchart in FIG. 5 is incorporated in a program 124 and is performed by a printer control unit 200. FIG. 6 is a view illustrating one operation that is performed according to the flowchart in FIG. 5, and illustrates operation of a printer 1 in points at time t1 to t5 in an unfolding manner along a transportation path Pc. Furthermore, in FIG. 6, function parts 50 to 52, and 60 to 63, each are indicated by a broken line, and hatching made from multiple slanted lines is performed on an image made only from color images, and hatching made from multiple points is performed on an image in which the white background image is superimposed on the color image.

In Step S201, an image recording mode is started. When this is done, formation and hardening of images I(1), I(2), and so forth to I(n) that are made only from the color image are sequentially performed with respect to the surface of the sheet S transported along the forward direction Df (a section of a point in time "t1" in FIG. 6). In Step S202 that follows, it is determined whether the formation and the hardening of the color image with regard to all of the images I(1), I(2), and I(3), which are prearranged, are completed. Then, when this completion is confirmed (when it is determined in Step S202 that the result is "YES"), the proceeding to Step S203 takes place, and the image recording mode is interrupted (a section of a point in time "t2" in FIG. 6).

When the image recording mode is interrupted, and the transportation of the sheet S stops, Step S204 is performed. In Step S204, a reverse transportation mode is executed, and the sheet S is transported along a reverse direction Db. When this is done, the end of the forward direction Df of the image I(1) is positioned at a position that is only a run-up distance Ls away in an upstream side of the forward direction Df from the recording head 50 (a section of a point in time "t3" in FIG. 6). When the reverse transportation mode in Step S204 is completed, the proceeding to Step S205 takes place and the image recording mode is resumed. In the resumed image recording mode, the white background image is superimposed on each of the images I(1) to I(3), each of which is made only from the color images. Then, in Step S206, when it is confirmed that the formation and the hardening of the background color are completed with respect to all of the images I(1), (2), and I(3) that are prearranged (when it is determined in Step S206, that the result is "YES"), the flowchart in FIG. 5 is ended.

Then, according to this embodiment, an amount of transportation of the sheet S is controlled, based on a result of detecting a rotational position of a platen drum 30 as in the first embodiment. When this is done, the amount of transportation of the sheet S may be precisely controlled.

As described above, according to this embodiment, Step S201 is performed in which the color image is formed on the sheet S using the multiple recording heads 51 that are arranged in a more downstream side of the forward direction Df than the recording head 50 for white, and Step S205 is performed in which the recording head 50 for white discharges an ink onto the image formed in Step S201 to record the background image. In other words, the background image is formed in Step S205 in such a manner as to be superimposed on the color image recorded in Step S201.

At this time, the color image is recorded in Step S201, using the recording head 51 that is in the more downstream side of the forward direction Df than the recording head 50 that records the background image in Step S205. Therefore, in Step S205, it is necessary to move the color image, which is formed in Step S201, in advance to a more upstream side of the forward direction Df than the recording head 50 is arranged, in order for the recording head 50 to form the background image on the color image, whose recording has been completed in Step S201, in a superimposing manner.

Therefore, according to this embodiment, the reverse transportation mode is executed prior to Step S205 (Step S204). Besides, since the amount of transportation of the sheet S in the reverse transportation mode is precisely controlled based on a result of detecting the rotational position of the platen drum 30, the sheet S may be precisely transported to an appropriate position for the image recording mode that is executed in Step S205. As a result, the background image that is formed in Step S205 may be precisely superimposed with respect to the color image whose formation has been completed in Step S201.

Others

As described above, according to the embodiments, the printer 1 is equivalent to the "image recording apparatus" according to the invention, the front drive roller 31 and the rear drive roller 32 cooperate to function as the "transportation unit" according to the invention, the platen drum 30 is equivalent to the "driven rotation member" and the "driven drum" according to the invention, the drum encoder E30 is equivalent to the "rotational position detection unit" according to the invention, the printer control unit 200 is equivalent to the "control unit" according to the invention, the sheet S is equivalent to the "recording medium" according to the invention, the surface of the sheet S is equivalent to the "one surface" according to the invention, the rear surface of the sheet S is equivalent to the "other surface" according to the invention, and the ink is equivalent to the "liquid" according to the invention. Furthermore, the recording heads 50, 51, and 52 are equivalent to the "discharge head" according to the invention, the forward direction Df is equivalent to the "first direction" according to the invention, the reverse direction Db is equivalent to the "second direction" according to the invention, the image tester 82 is equivalent to the "aberration detection unit" according to the invention, the maintenance unit 9 is equivalent to the "maintenance unit" according to the invention, the recording head 50 is equivalent to the "specific discharge head" according to the invention, Step S201 is equivalent to the "first step" according to the invention, Step S204 is equivalent to the second step according to the invention, and Step S206 is equivalent to the "third step" according to the invention.

Moreover, the invention is not limited to the embodiments, and various modifications to what are described above can be made within a range not deviating from the gist of the invention. For example, according to the embodiments, the rotational position of the platen drum 30 is detected by the drum encoder E30. However, a specific configuration in which the rotational position of the platen drum 30 is detected is not limited to the encoder. In short, if the configuration is such that the rotational position of the platen drum 30 can be detected, this is sufficient.

Furthermore, according to the embodiments, the amount of transportation of the sheet S is controlled based on the result of detecting the rotational position of the platen drum 30. However, the amount of transportation of the sheet S may be controlled based on the result of detecting the rotational position of any one of the driven rollers 33 and 34, by attaching the encoder to any one of the driven rollers 33 and 34 that are driven depending on the transportation of the sheet S.

Furthermore, according to the first embodiment, the operation in a case where the dot omission is detected as the aberration that occurs in the image recording mode is described as an example. However, the aberration that is a target for detection is not limited to the dot omission. Therefore, for example, adhesion of a foreign material to the surface of the sheet S may be detected as an aberration and thus the same operation as in the flowchart in FIG. 3 may be performed. In other words, in a case where the foreign material sensor 81 detects the foreign material, the image recording mode is interrupted until the removal of the foreign material (the maintenance) is completed. Then, when the removal of the foreign material is completed, the reverse transportation mode may be executed to transport the sheet to the position according to the resumed image recording mode. At this time, the amount of transportation of the sheet S may be controlled in the reverse transportation mode, based on the result of detecting the rotational position of the platen drum 30. When this is done, the amount of transportation of the sheet S can be precisely controlled.

Furthermore, the timing when the reverse transportation mode is executed is not limited to what is described above as an example. For a specific example, in a case where the sheet S is cut with the slice table 83 in order to remove the core pipe from the releasing shaft 20 or replace the sheet S, a cutting point of the sheet S may be transported to the splice table 83 by executing the reverse transportation mode. At this time, the cutting point of the sheet S may be appropriately positioned in the slice table 83, by controlling the amount of transportation of the sheet S in the reverse transportation mode, and thus by precisely controlling the amount of transportation of the sheet S, based on the result of detecting the rotational position of the platen drum 30.

Furthermore, according to the first embodiment, the image quality information BM is formed in the resumed image recording mode. However, this formation of the image quality information BM may be omitted, and the image recording mode may be resumed after the formation of the image I(7). In this case, the positional alignment between the leading end of the image I(7) and the recording heads 50, 51, and 52 may be performed by executing the reverse transportation mode in advance prior to the resumption of the image recording mode. Then, the sheet S can be precisely transported to the appropriate position for the resumed image recording mode, by controlling the amount of transportation of the sheet S in the reverse transportation mode based on the result of detecting the rotational position of the platen drum 30.

Furthermore, according to the embodiments, the speed control is performed with respect to the front drive roller 31, and on the other hand, the torque control is performed with respect to the rear drive roller 32. However, the torque control may be performed with respect to the front drive roller 31 and on the other hand, the rear drive roller 32 may be transformed in such a manner as to perform the speed control. At this time, the torque of the front drive roller 31 may be controlled in such a manner that the tension Tb of the sheet S that is wound up around the platen drum 30 that is in the more downstream side of the forward direction than the front drive roller 31 is greater than the tension Ta of the sheet S that is in the more upstream side of the forward direction Df than the front drive roller 31.

With this configuration, since the front drive roller 31 transports the sheet S along the forward direction Df while generating the braking torque, the transportation of the sheet S by the front drive roller 31 may be performed in a comparatively stable manner. As a result, the tension of the sheet S, which is transported by the front drive roller 31 and is wound onto the platen drum 30, may be stabilized. The occurrence of the slipping between the platen drum 30 and the sheet S may be certainly suppressed, and this is advantageous in precisely controlling the amount of transportation of the sheet S.

Furthermore, according to the embodiments, the case is described where the invention is applied to the printer 1 that uses the platen drum 30 that is driven depending on the sheet S. However, the invention can be also applied with respect to the printer that does not use such a platen drum 30. Therefore, the invention may be applied to the printer in which the sheet S may be intermittently transported on the plate-shaped platen, and the image may be formed on the sheet S that intermittently stops on the platen, for example, as disclosed in JP-A-2011-201158. Specifically, for example, the encoder may be attached to the driven roller that is driven depending on the transportation of the sheet S, and the transportation of the sheet S may be controlled based on the result of detecting a rotational angle of the driven roller.

Furthermore, various modifications to the examples described above may be made with respect to the specific configuration of the transportation system that transports the sheet S, the settings of the tension Ta, Tb, and Tc of the sheet S, the number and the arrangement of the recording heads 50, 51, and 52, the number of the arrangement of the UV lamps 60, 61, and 62, and the other configurations of the printer 1.

What is claimed is:

1. An image recording apparatus comprising:

a transportation unit that transports a recording medium;

a driven rotation member that rotates as a result of being driven depending on the recording medium which is transported by the transportation unit while in contact with the recording medium;

a rotational position detection unit that detects a rotational position of the driven rotation member; and a control unit that controls an amount of transportation of the recording medium based on a result of the detection by the rotational position detection unit.

2. The image recording apparatus according to claim 1, wherein the driven rotation member is a driven drum onto the peripheral surface of which the recording medium is wound.

3. The image recording apparatus according to claim 2, further comprising:

a discharge head that discharges a liquid onto one surface of the recording medium to record an image, wherein the recording medium is supported by winding the recording medium onto the driven drum beginning with the other surface that is the reverse side of the one surface, and wherein the discharge head discharges the liquid onto an part of the recording medium that is wound onto the driven drum.

4. The image recording apparatus according to claim 3, wherein the control unit selectively executes an image recording mode in which the discharge head discharges the liquid to record the image on the recording medium while the transportation unit transports the recording medium along a first direction and a reverse transportation mode in which the transportation unit transports the recordable media along a second direction, which is the reverse of the first direction, and controls the amount of transportation of the recording medium in the reverse transportation mode, based on a result of the detection by the rotational position detection unit.

5. The image recording apparatus according to claim 4, further comprising:

an aberration detection unit that detects an aberration which occurs in the image recording mode that is being executed, wherein the control unit interrupts the image recording mode in order for the transportation unit to stop transporting the recording medium, and performs a positional alignment between a position of the recording medium position at which recording of the image recording starts in the resumed image recording mode and the discharge head is performed, using the reverse transportation mode, when the aberration detection unit detects an aberration.

6. The image recording apparatus according to claim 5, wherein the aberration detecting unit detects the aberration that occurs in the image formed by the discharge head.

7. The image recording apparatus according to claim 6, wherein the discharge head discharges the liquid through a nozzle onto the recording medium to form a dot on the recording medium, and wherein the aberration detection unit detects a defect in dot formation that occurs due to the defect in discharge of the liquid through the nozzle.

8. The image recording apparatus according to claim 7, further comprising:

a maintenance unit that performs maintenance on the nozzle of the discharge head, wherein the control unit causes the maintenance unit to perform the maintenance with respect to the nozzle of the discharge head during an interval from stopping the image recording mode to resuming the image recording mode.

9. The image recording apparatus according to claim 4, wherein a plurality of the discharge heads including a specific discharge head are provided along a first direction, and wherein the control unit performs a first step in which the discharge head arranged in a more downstream side of the first direction than the specific discharge head while transporting the recording medium along the first direction discharges the liquid, and then executes the image recording mode, a second step in which, after performing the first step, the reverse transportation mode is executed, and then the image formed in the first step is moved to a more upstream side of the first direction than the specific discharge head is arranged, and a third step in which, after performing the second step, the specific discharge head discharges the liquid onto the image formed in the first step while transporting the recording medium along the first direction, and then executing the image recording mode.

10. The image recording apparatus according to claim 9, wherein the recording medium has optical transparency, and wherein the specific discharge head discharges a white liquid onto the recording medium.

11. The image recording apparatus according to claim 4, wherein the transportation unit includes, a releasing unit that releases the recording medium from a winding shaft around which the recording medium is wound up, and a drive roller, which is arranged between the releasing unit and the driven drum, and transports the recording medium released by the releasing unit toward the first direction, and wherein the control unit controls torque of the drive roller in such a manner that tension of the recording medium, which is wound onto the driven drum that is in the more downstream side of the first direction than the drive roller, is greater than tension of the recording medium that is in the more upstream side of the first direction than the drive roller.

12. The image recording apparatus according to claim 1, wherein the transportation unit gives tension equivalent to the tension that is given to the recording medium in the image recording mode to the recording medium in the reverse transportation mode.

13. A recording medium control method that controls an amount of transportation of a recording medium being transported by a transportation unit, the method comprising:

detecting a rotational position of a driven rotation member that rotates as a result of being driven depending on the recording medium which is transported by the transportation unit while in contact with the recording medium, and controlling the amount of transportation of the recording medium, based on a result of the detection in the detecting of the rotational position.

* * * * *